US010427871B2

(12) United States Patent
Fillion et al.

(10) Patent No.: US 10,427,871 B2
(45) Date of Patent: Oct. 1, 2019

(54) SCREW CONVEYOR SYSTEM FOR COMPACTION APPARATUS

(71) Applicant: 9103-8034 QUEBEC INC., Sant-Casimir (Quebec) (CA)

(72) Inventors: Michel Fillion, Beaumont (CA); Serge Gingras, Grondines (CA); Mathieu Gingras, St-Ubadle (CA); Jean-Sebastien Guilmette, Deschambault (CA)

( * ) Notice: Subject to any disclaimer, the term of this patent is extended or adjusted under 35 U.S.C. 154(b) by 169 days.

(21) Appl. No.: 15/030,435

(22) PCT Filed: Nov. 18, 2014

(86) PCT No.: PCT/CA2014/051103
§ 371 (c)(1),
(2) Date: Apr. 19, 2016

(87) PCT Pub. No.: WO2015/074146
PCT Pub. Date: May 28, 2015

(65) Prior Publication Data

US 2016/0280459 A1 Sep. 29, 2016

(51) Int. Cl.
*B65F 3/22* (2006.01)
*B30B 9/30* (2006.01)
*B30B 11/24* (2006.01)

(52) U.S. Cl.
CPC ..... *B65F 3/22* (2013.01); *B30B 9/3046* (2013.01); *B30B 9/3089* (2013.01); *B30B 11/246* (2013.01)

(58) Field of Classification Search
CPC ... B30B 11/246; B30B 9/3089; B30B 9/3046; B65F 3/22
USPC ..... 100/117, 145
See application file for complete search history.

(56) References Cited

U.S. PATENT DOCUMENTS 2,903,960 A * 9/1959 Zies ..... D21D 1/32 100/145
3,470,815 A * 10/1969 Erland ..... B30B 9/16 100/117
4,227,849 A * 10/1980 Worthington ..... B65F 3/046 414/408
4,567,820 A 2/1986 Munsell
4,640,659 A * 2/1987 Parks ..... B65F 3/22 100/98 R (Continued)

FOREIGN PATENT DOCUMENTS

CA 1096697 3/1981
CA 2716153 A1 * 3/2012 ..... B30B 9/3042

(Continued)

*Primary Examiner* — Jimmy T Nguyen

(57) ABSTRACT

A screw conveyor system for a compaction apparatus can be adapted on a material transportation vehicle. The compaction apparatus is characterized by having a hopper receiving materials and a container storing the materials in a compacted fashion. The compaction apparatus comprises a screw conveyor system that can include a screw conveying the materials from the hopper to the container, a passageway structure traversed by the screw, located between the hopper and the container and allowing passage of the materials. The passageway structure can define an asymmetrical aperture and the passageway structure can include a main passageway and a by-pass passageway allowing passage of materials from the hopper to the container.

24 Claims, 14 Drawing Sheets

(56) References Cited

U.S. PATENT DOCUMENTS

| | | | | |
|---|---|---|---|---|
| 4,655,128 | A | 4/1987 | St-Clair | |
| 5,000,307 | A | 3/1991 | Bruke | |
| 5,611,268 | A | 3/1997 | Hamilton | |
| 6,247,662 | B1 * | 6/2001 | Hamilton | B30B 9/3025 241/260.1 |
| 8,136,706 | B2 | 3/2012 | Jung | |
| 2001/3017328 | | 8/2001 | Hamilton | |
| 2012/0145012 | A1 * | 6/2012 | Koenig | B30B 9/3014 100/117 |
| 2013/0319264 | A1 * | 12/2013 | McLaughlin | B09B 3/00 100/345 |

FOREIGN PATENT DOCUMENTS

| | | |
|---|---|---|
| DE | 20307600 | 9/2003 |
| DE | 102005023375 | 11/2006 |
| EP | 2319685 | 5/2011 |
| GB | 2333489 | 7/1999 |
| JP | 52132555 | 11/1977 |
| JP | 62116411 | 5/1987 |
| JP | 62175302 | 11/1987 |
| JP | 2002370040 | 12/2002 |
| JP | 2006159202 | 6/2006 |
| JP | 2013193018 A | 9/2013 |

* cited by examiner

SCREW CONVEYOR SYSTEM FOR COMPACTION APPARATUS

CROSS-REFERENCE TO RELATED APPLICATIONS

This application is a national phase entry of PCT patent application serial number PCT/CA2014/051103, filed on Nov. 18, 2014, (now pending) designating the Unites States of America and claims priority under 35 USC § 119(e) of U.S. provisional patent application 61/906,095 filed on Nov. 19, 2013, the specification of which is hereby incorporated by reference.

FIELD OF THE INVENTION

The present invention relates to conveyor systems. More particularly, the present invention relates to a screw conveyor system for a compaction apparatus. The compaction apparatus can also be adapted on a material transportation vehicle.

BACKGROUND

Screw conveyors are used in compaction systems to displace bulky waste material along a path from one location to another. Such screw conveyors typically include a screw that can have a large pitch at the beginning of the path and a small pitch at the end of the path.

One example of known screw conveyors is disclosed in U.S. Pat. No. 5,611,268 (HAMILTON). HAMILTON teaches the use of a tapered passageway at the end of the path to further compact waste material. However, waste material elements that have irregular dimensions may jam at the entrance of the tapered passageway and cause problems in the flow of material along the path. This problem is generally encountered in the industry when screw conveyors similar in design to the one of HAMILTON are used.

EP 2319685 describes a compaction system that can be used on vehicles for transporting waste material. Such vehicles typically include a loading hopper to receive the waste material. The material is then transferred to a container through an aperture. Once again, materials of irregular dimensions may get blocked in the aperture.

Hence, in light of the aforementioned, there is a need for a screw conveyor system which, by virtue of its design and components, would be able to overcome or at least minimize some of the aforementioned prior art problems.

SUMMARY

In accordance with a first aspect, a screw conveyor system for a compaction apparatus is provided which comprises a hopper receiving materials and a container storing the materials in a compacted fashion. The screw conveyor system further comprises a screw conveying the materials from the hopper to the container and a passageway structure traversed by the screw, located between the hopper and the container and allowing passage of the materials. The passageway structure defines an asymmetrical aperture and the passageway structure comprises a main passageway shaped to be in close relation to a circumferential perimeter of the screw and a by-pass passageway extending outwardly beyond the circumferential perimeter of the screw and offset from the main passageway.

In an embodiment, the screw comprises a proximal segment, located in the hopper, and a distal segment, located in the container. The proximal segment of the screw can be located in a bottom portion of the hopper. A ratio between a length of the distal segment of the screw and a length of the container can be comprised between 20 and 50%. A portion of the proximal segment of the screw can traverse the passageway structure.

In an embodiment, the by-pass passageway is located in a top portion of the passageway structure.

In an embodiment, the by-pass passageway and the main passageway have respective aperture areas defining a ratio between 20 and 40%.

In an embodiment, the passageway structure comprises at least one inwardly projecting fin.

In an embodiment, a circumferential perimeter of the main passageway is substantially circular.

In an embodiment, a circumferential perimeter of the by-pass passageway comprises a square-shaped corner.

In an embodiment, the screw comprises a screw shaft, a helical screw blade extending around the screw shaft and having an outer edge, and a screw head plate affixed to an end of the screw shaft and extending perpendicularly thereto. The helical screw blade can comprise a first group of flights along the proximal segment and a second group of flights differing from the first group of flights along the distal segment. The first group of flights can have a first pitch and the second group of flights can have a second pitch different from the first pitch. Also, the first group of flights can have a first diameter and the second group of flights can have at least one second diameter smaller than the first diameter. In addition, the first group of flights can have a first edge thickness and the second group of flights can have a second edge thickness different from the first thickness.

In an embodiment, each one of the helical screw blade and the screw shaft has a surface provided with a hard facing pattern.

In an embodiment, the screw comprises at least one stabilizing rib connected to the screw head plate and to the screw shaft.

In an embodiment, the screw conveyor system further comprises a biasing mechanism configured to allow a deflection of the screw from a resting position along a longitudinal axis thereof and biasing the screw toward the resting position after said deflection. The biasing mechanism can comprise a driving plate, the screw head plate, biasly mounted in a parallel relationship with said driving plate and at least one spring-based component linking the driving plate and the screw head plate. The spring-based component can be a spring-biased bolt. The deflection of the screw allowed by the biasing mechanism can be between 0 and 5°.

In accordance with another aspect, there is provided a compaction apparatus comprising a hopper receiving materials, a container storing the materials in a compacted fashion and a screw conveyor system as described above.

In an embodiment, the hopper comprises a hopper trough, the proximal segment of the screw being received herein.

In an embodiment, the container comprises a container trough, the distal segment of the screw being received herein.

In accordance with another aspect, there is provided a material transportation vehicle comprising the compaction apparatus as described above and comprising a hopper intake located on a lateral side of the material transportation vehicle. Also, the screw conveyor system can be configured to convey materials toward the rear end of the material transportation vehicle.

In accordance with yet another aspect there is provided a compaction apparatus which comprises a hopper receiving materials, a container storing the materials in a compacted fashion and a screw conveyor system. The screw conveyor system can comprise a passageway structure located between the hopper and the container, a screw extending in the hopper and in the container and a drive mechanism operatively connected to the screw. The passageway structure can include an aperture with the screw extending therein, the screw being configured to convey the materials from the hopper to the container. The drive mechanism can comprise a variable delivery hydraulic motor operatively connected to the screw through a gear assembly for engaging the screw in rotation.

In an embodiment, the gear assembly comprises a reduction gear coupled to the hydraulic motor, a first drive gear operatively engaged with the reduction gear, a second drive gear operatively connected to the first drive gear and operatively connected to the screw.

In an embodiment, the compaction apparatus as described above further comprises a biasing mechanism mounted to the screw at a first end thereof and the drive mechanism further comprises a driving shaft operatively connected to the screw at the first end thereof. The biasing mechanism can allow a deflection of the screw from a resting position along a longitudinal axis thereof and can bias the screw toward the resting position after said deflection.

In accordance with another aspect, there is provided a material transportation vehicle comprising the compaction apparatus as described above. In an embodiment, the material transportation vehicle comprises an engine and the variable delivery hydraulic motor is operatively connected and driven by the engine of the material transportation vehicle.

In accordance with yet another aspect, there is provided a mobile compaction apparatus comprising a compaction apparatus receiving frame supported on wheels, having a front and a rear end, a hopper mounted to the compaction apparatus receiving frame and configured to receive materials and a container mounted to the compaction apparatus receiving frame and configured to store the materials in a compacted fashion. The hopper is mounted forwardly of the container on the compaction apparatus receiving frame. A screw conveyor system comprises a passageway structure located between the hopper and the container and includes an aperture extending therethrough allows passage of the materials therein, and a screw extending in the hopper and the container and through the aperture conveys the materials rearwardly from the hopper to the container.

In an embodiment, the hopper comprises a hopper intake located on a lateral side of the mobile compaction apparatus.

In an embodiment, the compaction apparatus receiving frame comprises a towing engine coupling at the front end, the towing engine coupling being engageable with a towing engine.

In an embodiment, the compaction apparatus receiving frame comprises an engine cab at the front end and adjacent to the hopper.

DETAILED DESCRIPTION OF EMBODIMENTS

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In accordance with one aspect, there is provided a screw conveyor system for a compaction apparatus according to one embodiment.

Figure 14:
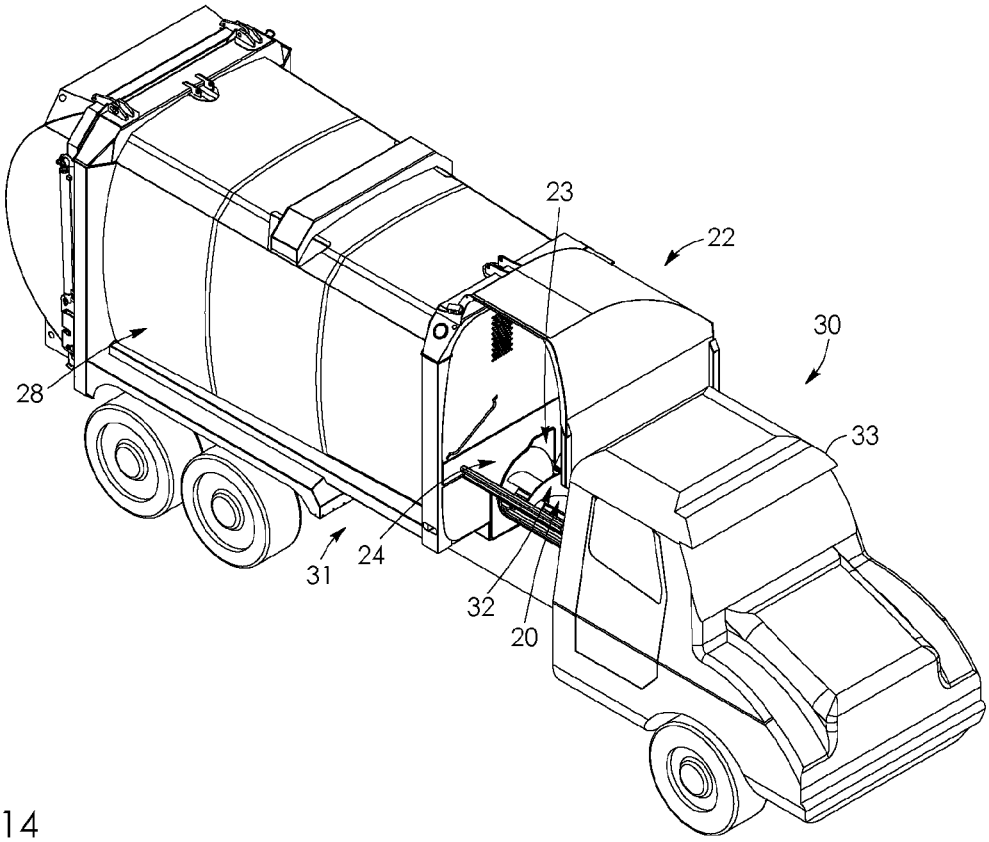
FIG. 14 is a perspective view of a compaction apparatus mounted on a material transportation vehicle.

Referring to FIG. 14, a screw conveyor system 20 according to one embodiment and a compaction apparatus 22 are generally illustrated. The compaction apparatus has a hopper 24 receiving materials for compaction, and a container 28 storing the materials in a compacted fashion. The compaction apparatus 22 is to be understood as a device that promotes the reduction in volume of the processed material. Compaction is advantageous when the most quantity of materials needs to be contained in a given volume, such as the container 28 or the like. In some implementations, the compaction apparatus 22 may be mounted on a material transportation vehicle 30, as shown herein. In other variants, the compaction apparatus may be provided in a plant or other structure where large size materials that need to be stored and disposed. For example, the materials can include waste material, recyclable material or organic waste.

The screw conveyor system 20 first includes a screw 32 conveying the materials from the hopper 24 to the container 28 of the compaction apparatus 22. The screw 32 is to be understood as a conveyor screw, therefore designed to convey the material along a path. More details on the screw and other components of the screw conveyor system 20 are provided further below.

Figure 5:
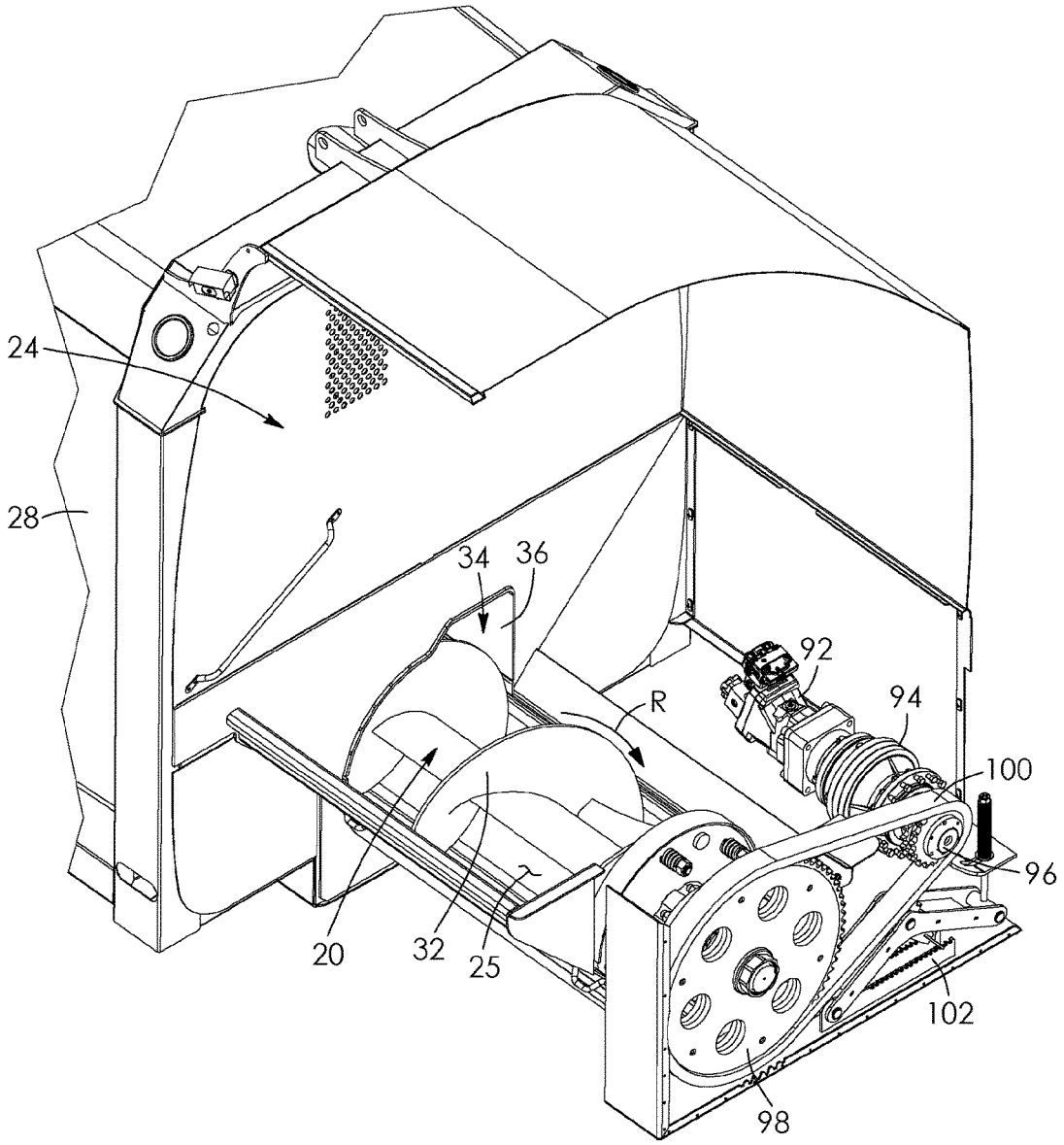
FIG. 5 is a perspective view, fragmented, of the components required to drive the screw conveyor in accordance with an embodiment, with a chute panel omitted above the hydraulic motor.
Figure 9:
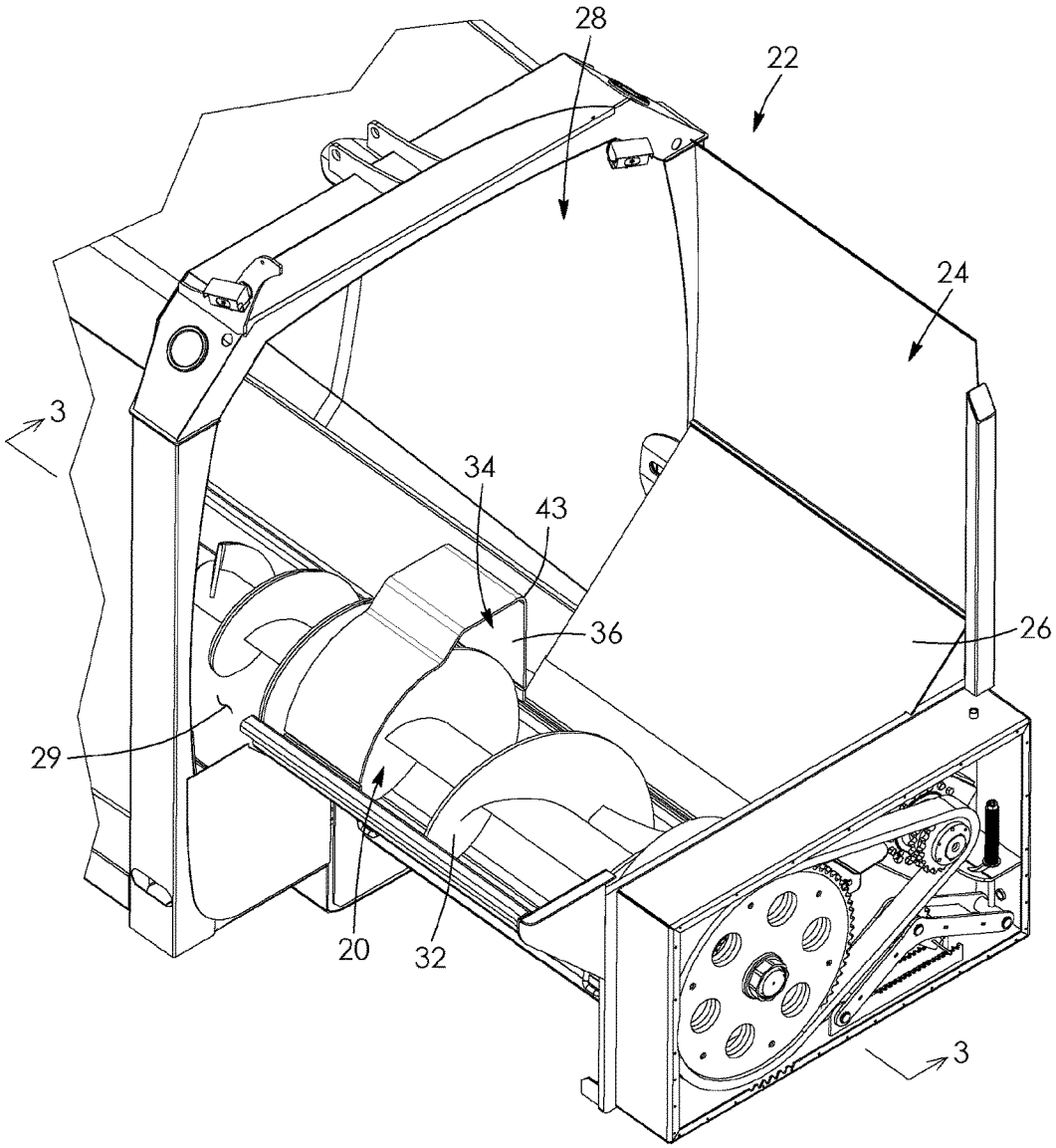
FIG. 9 is a partially cut perspective view, fragmented, of the screw conveyor system and passageway structure in accordance with an embodiment, with the wall between the container and the hopper and the hopper top panel omitted.

Referring to FIGS. 5 and 9, in some implementations the hopper 24 is dimensioned to receive a certain volume of the materials and is shaped to direct, under the force of gravity, the materials to the screw conveyor system 20. It is to be understood that the hopper 24 is not necessarily a funnel-shaped receptacle. The hopper 24 may have inclined chute panels 26 so that materials contained in the hopper 24 are directed to the screw conveyor system 20. The hopper 24 may also include a hopper trough 25, shaped to be in close relation to the screw 32 and positioned in a bottom portion of the hopper 24.

Figure 10:
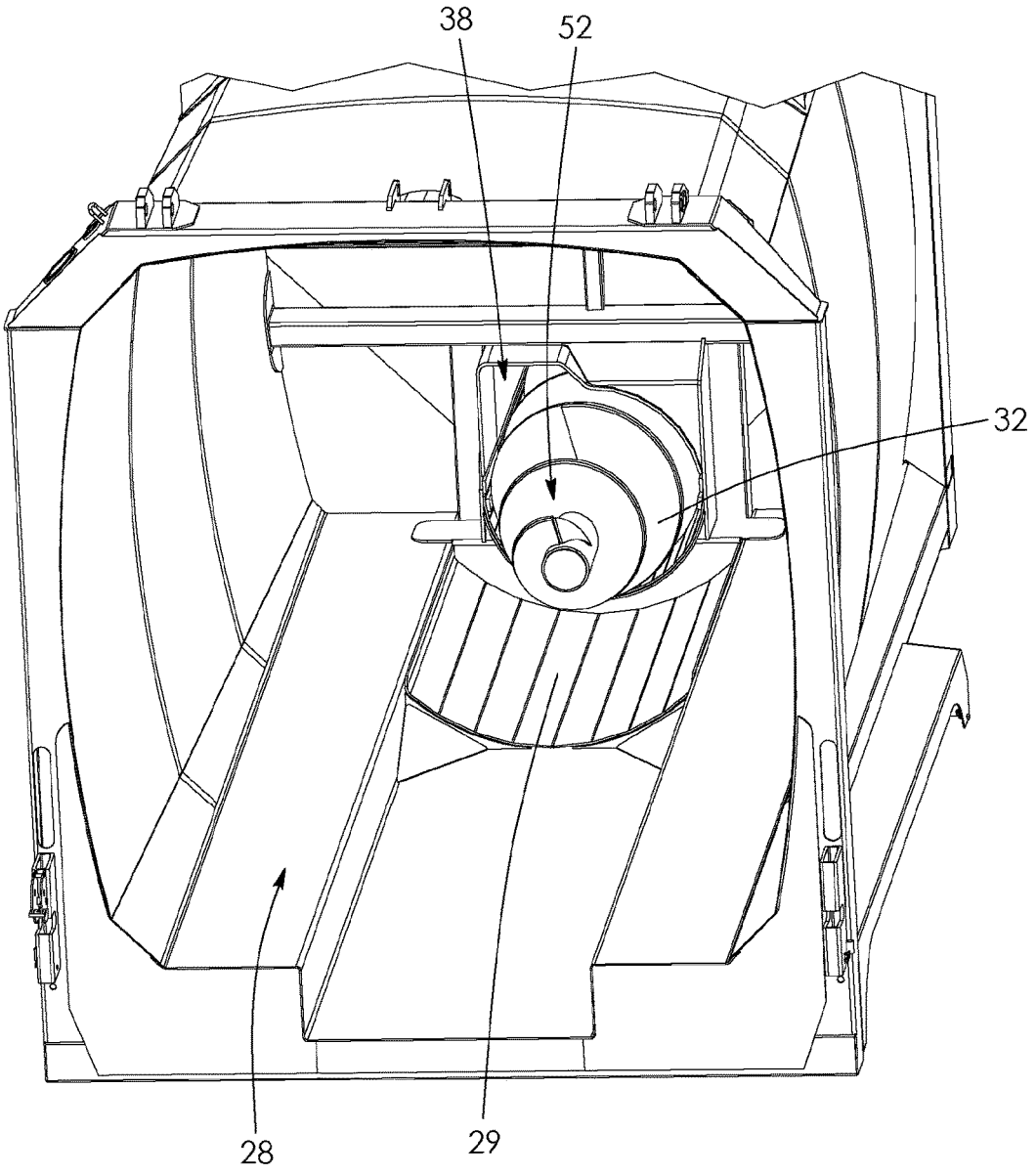
FIG. 10 is a rear perspective view, fragmented, of the container showing a screw conveyor system in accordance with an embodiment.

Referring to FIG. 10, the container 28 is dimensioned to receive a certain volume of the materials. The container 28 may also include a container trough 29, positioned in a bottom portion of the container 28.

Referring to FIGS. 3, 5, 8 and 10, the conveyor system according to an embodiment will now be described in more detail.

As mentioned above, the conveyor system 20 includes a screw 32, such as a conveyor screw, conveying the materials from the hopper 24 to the container 28.

In the illustrated embodiment, the screw 32 includes a screw shaft 48, a helical screw blade 54 extending around the screw shaft 48 and having an outer edge 44, and a screw head plate 56 affixed to an end of the screw shaft 48 and extending perpendicularly thereto. More details about those components will be described later. Generally, the screw 32 can be made of metallic material such as steel or any suitable material for the purpose of the here described compaction apparatus 22. The screw 32 further includes a proximal segment 50 and a distal segment 52. The screw proximal segment 50 is closest to the screw head plate 56 and the distal segment 52 is the farthest. The proximal 50 and distal 52 segments can differ in many aspects. As a person skilled in the art of screw conveyor systems would know, the screw can have multiple pitches, flight diameters and flight thickness along its length, among many other characteristics that can be exhibited by a screw 32 for a screw conveyor system 20.

Figure 3:
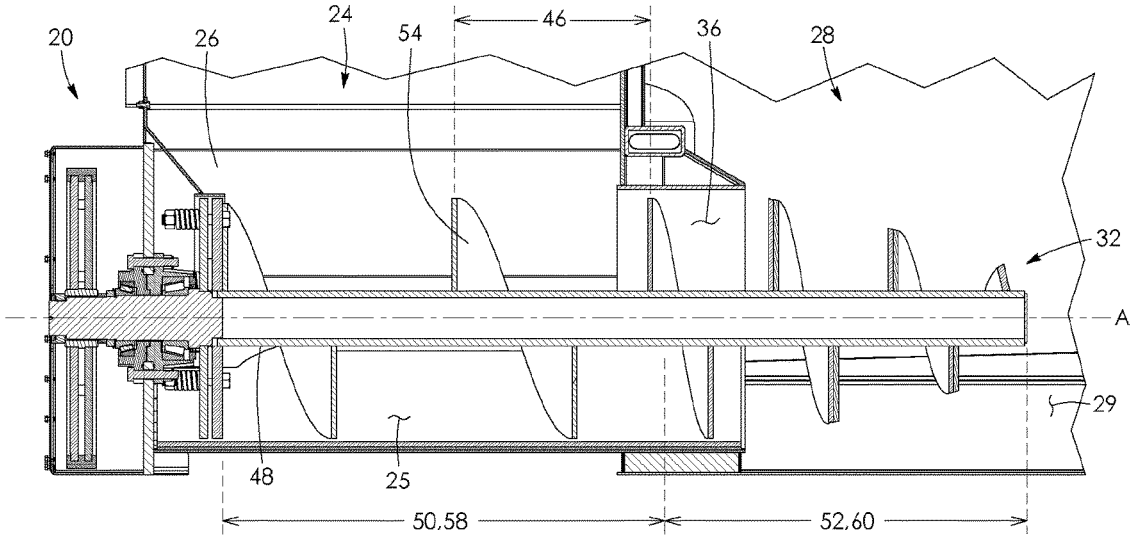
FIG. 3 is a sectional view, fragmented, along cross-section line 3-3 of FIG. 9 illustrating the screw conveyor system in accordance with an embodiment.
Figure 8:
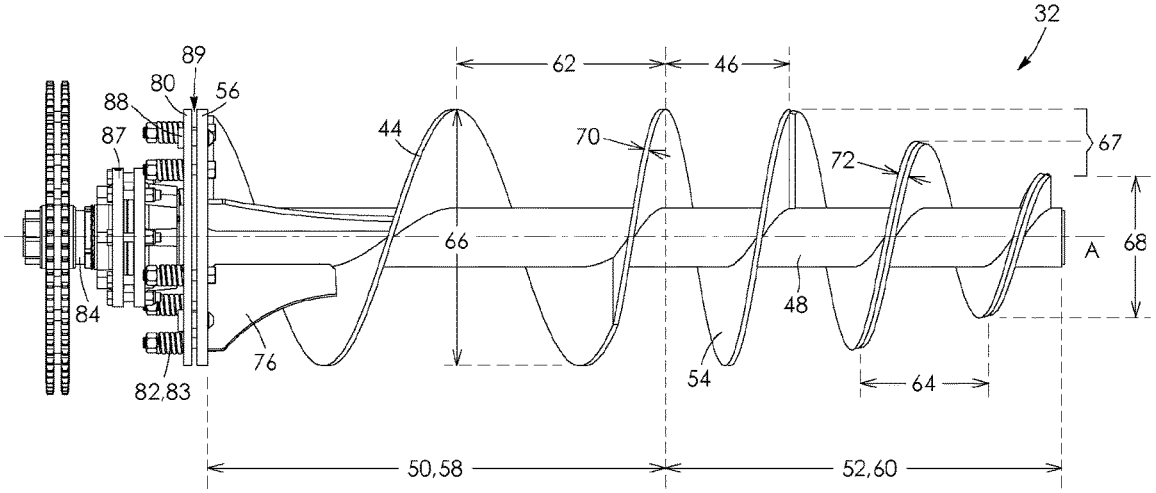
FIG. 8 is a side elevation view of the screw in accordance with an embodiment.

In the embodiment shown in FIGS. 3 and 8, the screw 32 includes a first group of flights 58 along the proximal segment 50 and a second group of flights 60, differing from the first group of flights 58, along the distal segment 52. These first and second groups of flights 58, 60 can vary from each other according to a plurality of characteristics.

In the illustrated embodiment of FIGS. 3 and 8, the first group of flights 58 has a first pitch 62 and the second group of flights 60 has a second pitch 64 different from the first pitch 62. The first pitch 62 is longer than the second pitch 64. In the illustrated implementation, by way of example only, the first pitch 62 is about 24 inches (610 millimeters) and the second pitch 64 is about 12 inches (305 millimeters). It is appreciated that the pitches can vary from the above-described embodiment. In some implementations, the ratio of the second pitch 64 to the first pitch 62 is between 40% and 60%. The pitches of the screw 32 can be selected depending on the material to be conveyed and according to the degree of compaction desired. The decrease in the pitch of the screw 32 from the first group of flights 58 to the second group of flights 60 can enhance the degree of compaction achieved by the waste compaction apparatus 22. Also, a longer first pitch 62 promotes the conveyance of material along a further distance for one rotation of the screw 32. Accordingly, the first pitch 62, characterizing the proximal segment 50 of the screw 32, can promote a quick conveyance of the material from the hopper 24 toward the container 28 so that the hopper 24 can be cleared from materials quickly. The second pitch 64, characterizing the distal segment 52 of the screw 32, can promote a higher degree of compaction.

Still referring to the illustrated embodiment of FIGS. 3 and 8, the first group of flights 58 has a first diameter 66 and the second group of flights 60 has a second diameter 68 different from the first diameter 62. The first diameter 66 is greater than the second diameter 68 while comprising gradually decreasing diameters 67 between the first 66 and second 68 diameters. In the illustrated implementation, the first diameter 66 is about 24 inches (610 millimeters) and the gradually decreasing diameters 67 range between about 24 inches (610 millimeters) to about 12 inches (305 millimeters) at the second diameter 68. It is appreciated that the diameters can vary from the above-described embodiment. In accordance with another embodiment, the ratio of the second diameter 68 to the first diameter 66 is between 40% and 60%. The diameters of the screw 32 can be selected depending on the material to be conveyed and according to the degree of compaction desired. A greater first diameter 66 on the proximal segment 50 promotes the conveyance of large size materials toward a passageway structure 34, which will be described in more details below. The second diameter 68, characterizing the distal segment 52 of the screw 32, can promote a higher degree of compaction in the container 28. As the container 28 fills up with compacted or shredded materials and as the screw 32 continuously pushes the materials away from the screw 32 in the container 28, compression efforts can be exerted on the screw 32 along its longitudinal axis A. Accordingly, the second diameter 68 can be selected so as to limit the compression efforts on the screw 32 while promoting a certain degree of compaction.

In the illustrated embodiment of FIGS. 3 and 8, the first group of flights 58 has a first edge thickness 70 and the second group of flights 60 has a second edge thickness 72 different from the first edge thickness 70. In this embodiment, the second edge thickness 72 is thicker than the first edge thickness 70. The edge thicknesses of the screw 32 can be selected depending on the material to be conveyed and according to the degree of compaction desired. The increase in edge thickness of the screw 32 increases the life of the screw conveyor system 20 because as the container 28 fills up with compacted or shredded materials and as the screw 32 continuously pushes the materials in the container 28, compression efforts can be exerted on the screw 32 along the screw 32 longitudinal axis A. Accordingly, the second edge thickness 72 can be selected so that the helical screw blade 54 can withstand the compression efforts on the screw 32 while promoting a certain degree of compaction and limiting the overall weight of the screw 32.

Figure 13:
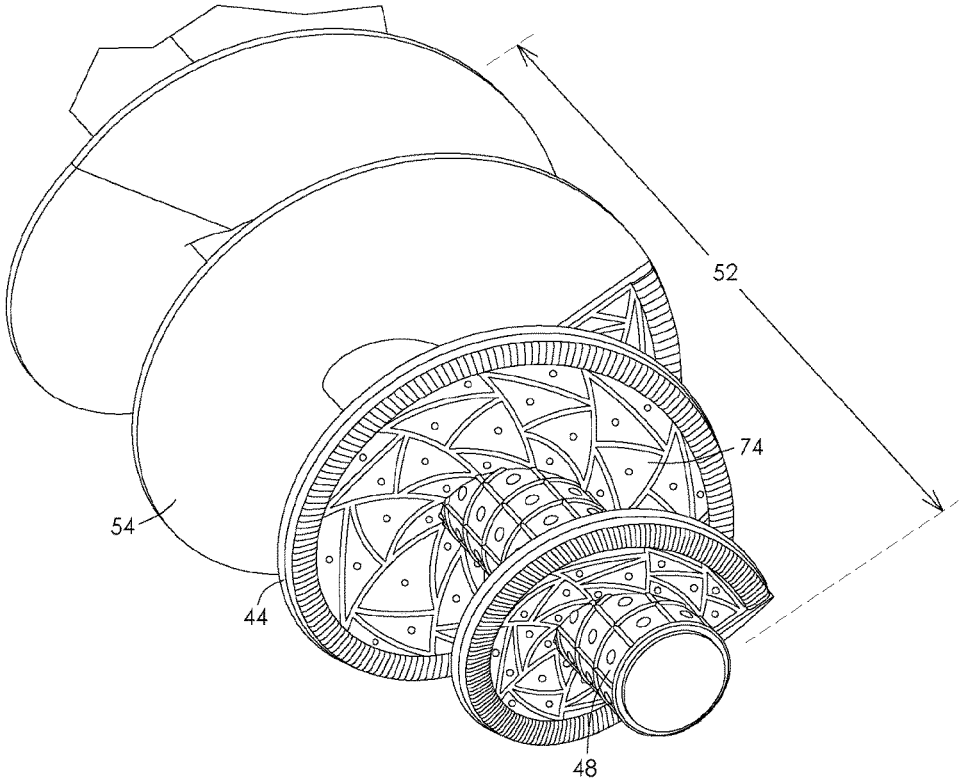
FIG. 13 is an enlarged perspective view, fragmented, of the screw shown in FIG. 9, with a hard facing pattern partially applied on the screw.

Referring now to FIG. 13, the helical screw blade 54 and the screw shaft 48 can include on their respective surfaces a hard facing pattern 74 on at least on a portion thereof. This hard facing pattern 74 can be applied by weld passes. The hard facing pattern 74 can increase the life of the screw 32 by preventing wear of the helical screw blade 54 and outer edge 44. Furthermore, the hard facing pattern 74 can promote a gripping effect between the helical screw blade 54 and the conveyed material, hence increasing the friction and the above-described shearing efforts resulting in the interaction of the screw conveyor system 20 and the processed materials.

Figure 7:
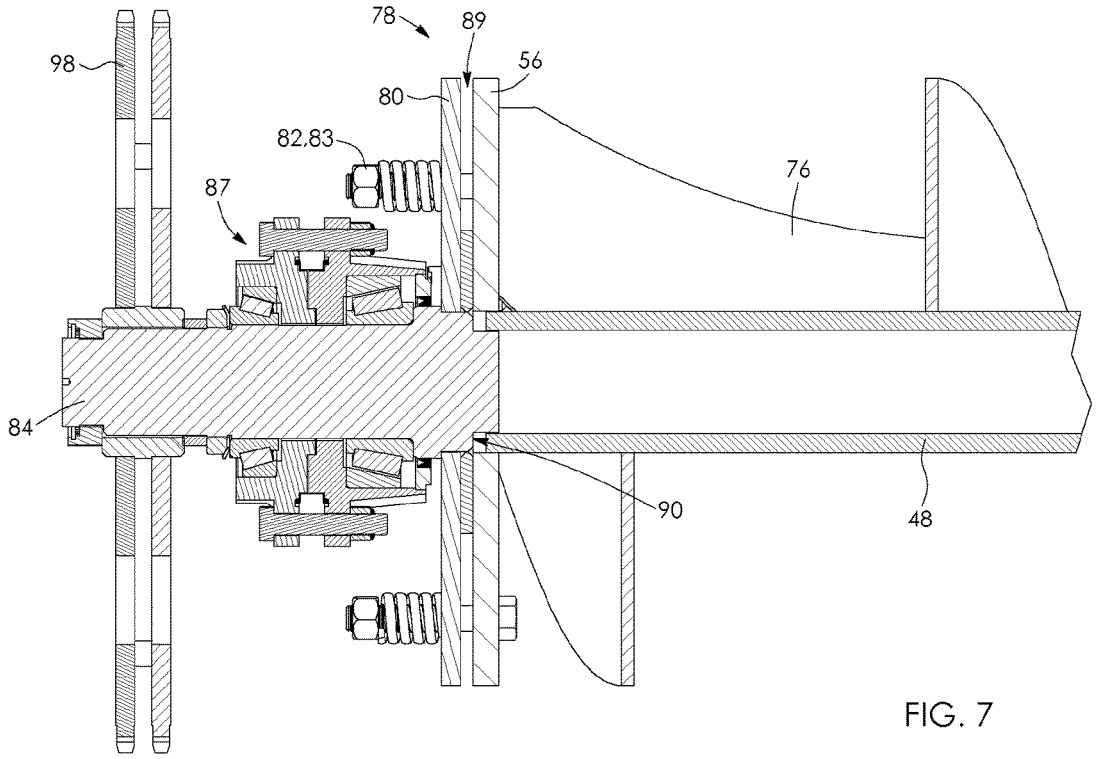
FIG. 7 is a sectional view, fragmented, along cross-section line 7-7 of FIG. 6 of the screw conveyor's head assembly in accordance with an embodiment.
Figure 12:
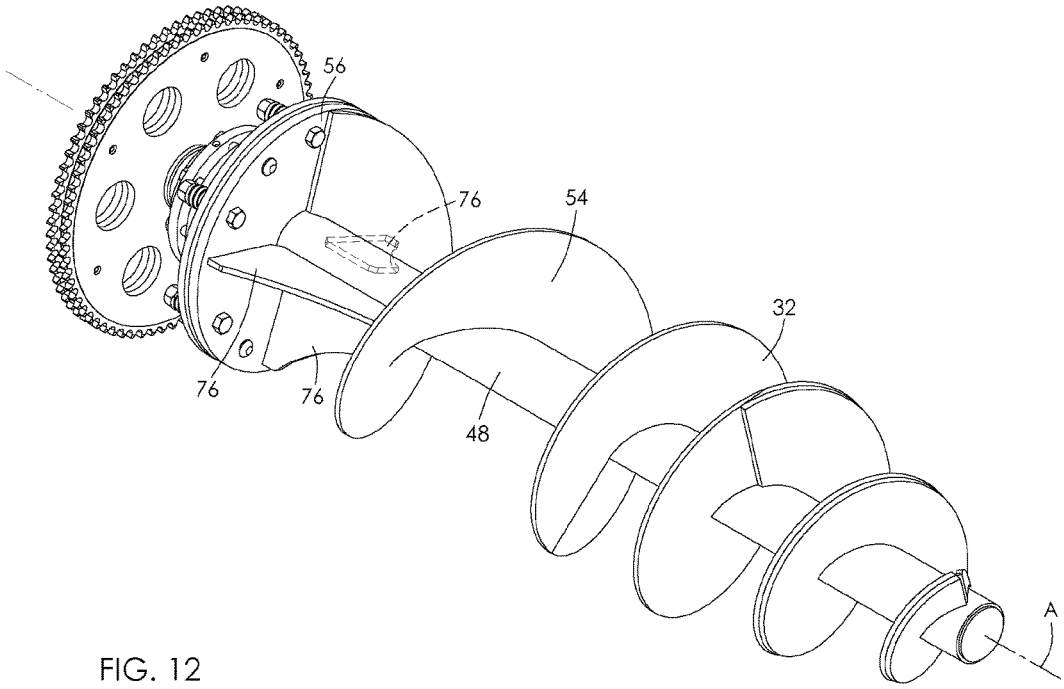
FIG. 12 is a perspective view of the screw shown in FIG. 8.

Now referring to FIGS. 7, 8 and 12, in some implementations, the screw 32 can include at least one stabilizing rib 76, extending perpendicularly to the screw shaft 48, connected to the screw head plate 56 and to the screw shaft 48. The stabilizing rib 76 can increase the life of the screw 32 by providing stability along the longitudinal axis A of the screw 32 during conveyance of material and by further affixing the screw head plate 56 to the screw shaft 48. In addition, the stabilizing rib 76 can enhance the shredding effect of the screw conveyor system 20 by gripping material in the hopper and forcing it between the stabilizing rib 76 and the hopper trough 25. This interaction can provide a cutting effect, resulting in the cutting of the material into smaller pieces prior to be conveyed into the container 28.

With reference to FIGS. 1, 2, 5 and 9, according to one aspect, the screw conveyor system 20 includes the passageway structure 34 traversed by the screw 32. The passageway structure 34 is located between the hopper 24 and the container 28 and allows passage of the materials conveyed by the screw 32 from the hopper 24 to the container 28. In some embodiments, the passageway structure 34 is to be understood as a tunnel-like passage between the hopper 24 and the container 28.

Figure 1:
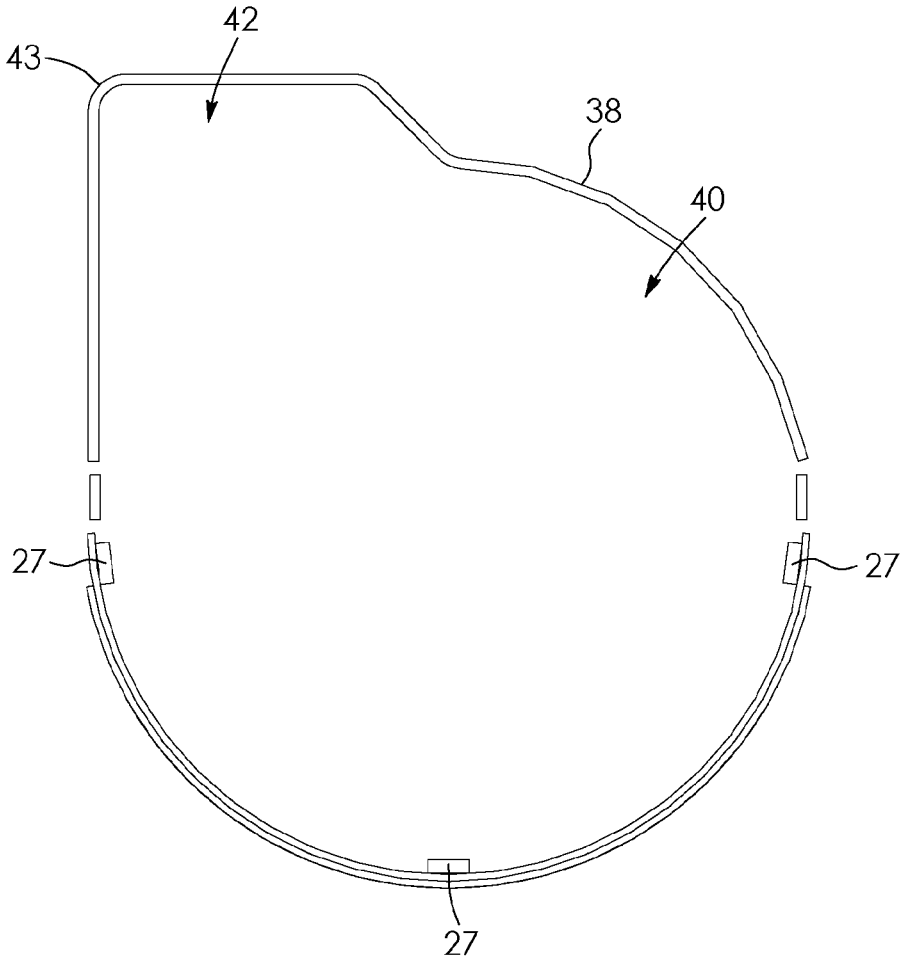
FIG. 1 is an enlarged front elevation view, fragmented, of the asymmetrical aperture defined by a passageway structure in accordance with an embodiment, with the screw omitted.
Figure 2:
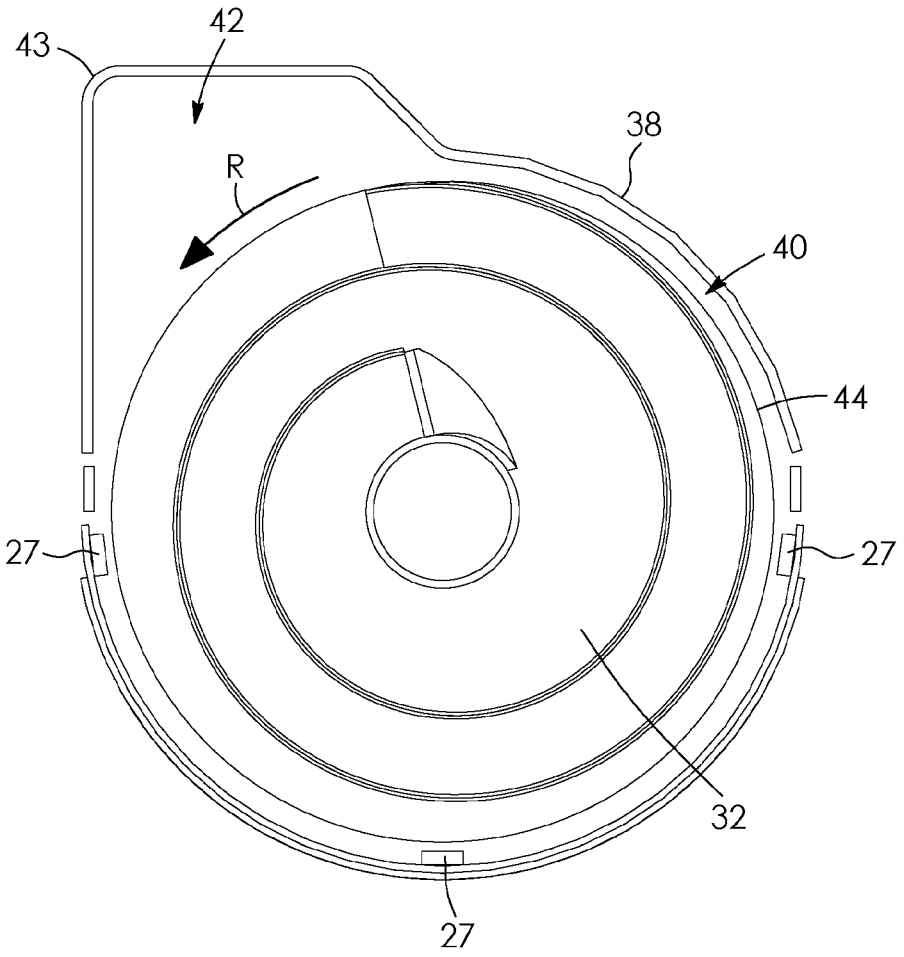
FIG. 2 is an enlarged front elevation view, fragmented of the asymmetrical aperture defined by the passageway structure shown in FIG. 1, with the screw.

Referring to FIGS. 1, 2, 5 and 9, the passageway structure 34 defines an asymmetrical aperture 38. The passageway structure 34 includes a main passageway 40 shaped to be in close relation to an outer circumferential perimeter of the screw 32, and a by-pass passageway 42 extending outwardly beyond the outer circumferential perimeter of the screw 32 and offset from the main passageway 40. Referring to FIGS. 1 and 2, the asymmetrical aspect of the aperture 38 of the passageway structure 34 is shown embodied by the shape and offset position of the by-pass passageway 42 in relation to the main passageway 40. In other words, both main passageway 40 and by-passageway 36 define one passageway structure 34 wherein the aperture 38 defined by the passageway structure 34 is asymmetrical when viewed cross-sectionally. It will be noted that in the illustrated embodiment the asymmetrical aperture 38 of the passageway structure 34 extends substantially normally to the longitudinal axis A of the screw 32. Alternatively, in another embodiment (not illustrated), the asymmetrical aperture 38 of the passageway structure 34 can define an oblique angle with the longitudinal axis A of the screw 32. More details about both the main and the by-pass passageways 40, 42 will be provided further below.

The passageway structure 34 also includes passageway walls 36 that can define a straight passageway as shown in FIG. 5, the asymmetrical aperture 38 being perpendicular to the passageway walls 36. Alternatively, the passageway walls 36 can define a tapered passageway (not illustrated), the asymmetrical aperture 38 defining an oblique angle with the passageway walls 36. Referring now to FIG. 3, it is shown that the passageway walls 36 are substantially planar. However, it is appreciated that, in alternative embodiments (not illustrated), the passageway walls 36 can be curved in a convex or concave fashion, thereby varying the cross-section surface area of the passageway structure 34 along its length.

Still referring to FIGS. 1 and 2, the main passageway 40 is shaped to be in close relation to an outer edge 44 of the screw 32. In some implementations, the circumferential perimeter of the main passageway 40 is substantially circular. In the implementation shown in FIGS. 1 and 2, the clearance between the outer edge 44 of the screw and the passageway walls 36 of the main passageway 40 is about % of an inch (19.1 millimeters). The main passageway 40 is qualified as main since during operation of the screw conveyor system 20, a first type of objects, contained in the processed materials conveyed by the screw 32, passes there through in order to pass from the hopper 24 to the container 28. This first type of objects can include objects that are shaped and/or dimensioned to be conveyed by the screw flights 46. Furthermore, this first type of objects can include objects that are compressible and that can be compressed by the action of the screw 32 when conveying this first type of objects through the main passageway 40.

In the illustrated embodiment of FIGS. 1 and 2, the main passageway 40 is shaped to be circular in order to be in close relation to the screw outer edge 44. Alternatively, the main passageway 40 can be of other suitable shapes and does not need to be in close relation to the outer edge 44 of the screw. The closely-related circular shape of the main passageway 40 may be advantageous because the rotation of the screw 32 in the main passageway 40 can compress the first type of objects between the screw flights 46, the screw shaft 48 and the passageway walls 36, resulting in the first type of objects being compacted so that they can be stored in the container 28 in a compacted fashion. For the purpose of the present application, the result of the materials being compacted during the passage in the main passageway 40 is called primary compaction hereinafter. A secondary compaction mechanism will be described further.

Still referring to FIGS. 1 and 2, the circumferential perimeter of the by-pass passageway 42 may be shaped to extend outwardly beyond the outer circumferential perimeter of the main passageway 40 and offset from the main passageway 40. In an embodiment, the by-pass passageway 42 also includes a right-angle corner 43. The by-pass passageway 42 is qualified as by-pass so that a second type of object, that is, objects that cannot be conveyed or compressed through the main passageway 40, can pass through the by-pass passageway 42. The by-pass passageway 42 defines an aperture that provides extra spacing between the screw 32 and the passageway walls 36, providing a passage from the hopper 24 to the container 28 to the second type of objects.

In the embodiment shown in FIGS. 1, 2, 5 and 9, the rotation R of the screw 32 is clockwise when considered looking from the hopper 24 and toward the container 28. In this embodiment, the by-pass passageway 42 is located in the top right corner of the passageway structure 34 from the same direction. In this embodiment, during rotation of the screw 32, objects of the second type can be stopped from rotating by having contact points with the passageway walls 36 of the by-pass passageway 42, for example on one of the walls of the right-angle corner 43. Therefore, the conveyance of second type objects by the screw flights 46 into the by-pass passageway 42 to the container 28 is promoted as those objects can pass through the by-pass passageway 42.

Referring to FIGS. 1 and 2, in the illustrated variant the position of the by-pass passageway 42 in a top portion of the passageway structure 34 advantageously directs objects of the second type to the by-pass passageway 42 since the chute panels 26 of the hopper 24 can help direct the objects thereto. This position also promotes the conveyance of the materials received in the hopper 24 so that a larger quantity of materials can be processed in a shorter amount of time. In addition, this position can minimize the jamming of the screw conveyor system 20 by providing a more direct passage for objects of the both the first and second types to the container 28, hence increasing the overall performance of the screw conveyor system 20.

In the embodiment shown in FIGS. 1 and 2, the by-pass passageway 42 and the main passageway 40 have respective aperture areas defining a ratio between 20 and 40%. This ratio has an impact on the size of the second type of objects that can pass through the by-pass passageway 42. If the ratio is high, larger second type objects can pass there through and the risks of jamming the screw conveyor system 20 can be reduced. One skilled in the art will know to select a ratio large enough so that the risks of jamming the screw conveyor system 20 with objects of the second type are low, and small enough to prevent the compacted materials stored in the container 28 to be drawn back to the hopper 24 during operation of the screw conveyor system 20.

Figure 11:
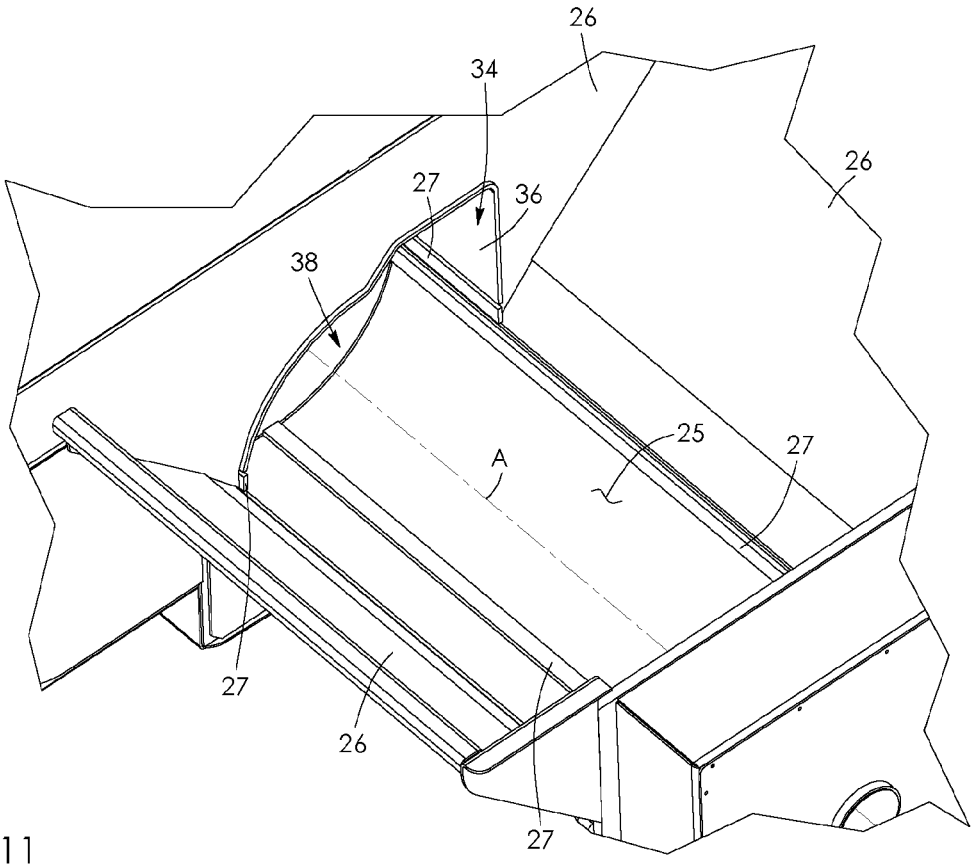
FIG. 11 is a perspective view, fragmented, of the hopper in accordance with an embodiment, with the screw conveyor omitted.

Referring to FIGS. 1, 2 and 11, the hopper trough 25 and the passageway structure 34 can include at least one inwardly projecting fin 27, extending along the hopper trough 25 and into the passageway structure 34 in a parallel fashion to the longitudinal axis A of the screw 32. Alternatively, the at least one inwardly projecting fin 27 can extend helically along those structures. An inwardly projecting fin 27 can help restrain the materials from rotating with the screw 32 and help avoid jamming of the screw conveyor system 20. Furthermore, an inwardly projecting fin 27 can act as a wear guide to prevent the screw 32 to wear the hopper trough 25 or the passageway structure 34. The inwardly projecting fin 27 is dimensioned so that a clearance between the fin 27 and the screw 32 is of a few millimeters. In an embodiment, the clearance is about 3/16 of an inch (4.8 millimeters). Accordingly, the inwardly projecting fin 27 can be of any shape and made of materials suitable for the above-mentioned purposes, such as steel. In the embodiment shown on FIGS. 1, 2 and 11, the three inwardly projecting fins 27 are parallelepipeds and positioned, using a clock position terminology according to the longitudinal axis A of the screw 32, at 3, 6 and 9 o'clock in both the hopper trough 25 and the passageway structure 34. Other number and configurations of fins could be considered without departing from the scope of the present description.

In the embodiment shown in FIGS. 1, 2, 5 and 11, the by-pass passageway 42 can also have an impact on the compaction of the processed materials. As described above, materials are conveyed by the screw 32 from the hopper 24 to the container 28, materials are forced to pass through the asymmetrical aperture 38 defined by the passageway structure 34. During operation, materials conveyed by the screw flights 46 are eventually in contact with the chute panels 26 and the passageway walls 36. As the screw 32 rotates, friction between the screw flights 46 and the materials can increase because the materials can be stopped from rotating by having contact points with immovable parts of the screw conveyor system 20, such as the chute panels 26, an inwardly projecting fin 27 or the passageway walls 36. Accordingly, shearing efforts are applied on the materials and those efforts can ultimately break and/or shred the materials into smaller pieces as they pass through the passageway structure 34. Furthermore, if material is spread on both sides of a screw flight 46 and is stopped from rotating by having contact points with immovable parts of the screw conveyor system 20, such as the chute panels 26, an inwardly projecting fin 27 or the passageway walls 36, the screw outer edge 44 can cut the material as the screw 32 rotates. Those above-mentioned mechanisms have the effect to shred the materials into smaller pieces and to compress those smaller pieces as they pass through the passageway structure 34. Those shredded materials, comprising objects of both the first and second types defined above, can promote the reduction in volume of the processed materials and therefore arrive in the container 28 in a compacted fashion.

In the embodiment shown in FIGS. 3, 8, 9 and 10, a portion of the proximal segment 50 of the screw 32 traverses the passageway structure 34. The remainder of the proximal segment 50, as mentioned above, is located in the hopper 24, more precisely in a bottom portion of the hopper 24. Even more precisely, the proximal segment 50 is located above the hopper trough 25. Accordingly, the proximal segment 50 of the screw 32 is received in the hopper trough 25.

In one variant, the clearance between the hopper trough 25 and the screw outer edge 44 of the proximal segment 50 can be of about 11/16 of an inch (17.5 millimeters). The distal segment 52 is located in the container 28, more precisely above the container trough 29. Accordingly, the container 28 includes a container trough 29 receiving the distal segment 52 of the screw 32 herein. The container trough 29 can have an impact on the compaction occurring in the container 28, called secondary compaction hereinafter. As more and more material are conveyed in the container 28, the distal segment 52 can further compact the materials being more and more packed in the container 28, leading to a greater degree of compaction than that provided with primary compaction described above. The container trough 29 can help the distal segment 52 of the screw 32 grip compressed and shredded materials located in the container 28 and promote secondary compaction. Furthermore, the container trough 29 can promote spreading the material throughout the container 28 in a more uniform manner and prevent materials from returning back to the hopper 24.

In some implementations, the ratio between the length of the distal segment 52 of the screw 32 and the length of the container 28 is comprised between 20 and 50%. For instance, considering that the distal segment 52 is 40 inches (1.016 meters) long, in a container of 25 cubic yards having an interior length of 164.5 inches (4.178 meters), the ratio is about 24.3%. In another embodiment, still considering that the distal segment 52 is 40 inches (1.016 meters) long, in a 14 cubic yards container having an interior length of 95.5 inches (2.426 meters), the ratio is about 41.8%. This ratio can have an impact on the degree of compaction achieved by the compaction apparatus and/or the life of the compaction apparatus 22. One skilled in the art will know to select a ratio large enough so that the screw 32 has sufficient grip on materials to provide sufficient secondary compaction, and small enough to limit wasting energy rotating the screw 32 and almost continuously turning and compressing the materials located in the container while not achieving a greater degree of compaction.

In an embodiment, where the ratio is comprised between 20 and 50%, compaction experiments have shown that a density of about 1300 pounds per cubic yard can be achieved when the materials are common household waste materials. This value is significantly better than what is usually obtained in other compaction apparatus for the same given application, such as pusher plate-based compaction apparatus, where a density of 900 pounds per cubic yard is reached.

It is to be understood that all the above mentioned characteristics are included only for illustrative purposes and can be varied in accordance with the application and size of the apparatus. For instance, the screw 32 does not necessarily have to include a shaft and could be in the form of a shaftless spiral (not illustrated), which is commonly known for a person skilled in the art of screw conveyor systems. In addition, the screw can include two distinct shafts (not illustrated) extending in alignment and/or in a parallel fashion with each other wherein the first and second shafts can exhibit screws differing in the same ways as the proximal 50 and distal 52 segments of the screw 32 described above.

Figure 6:
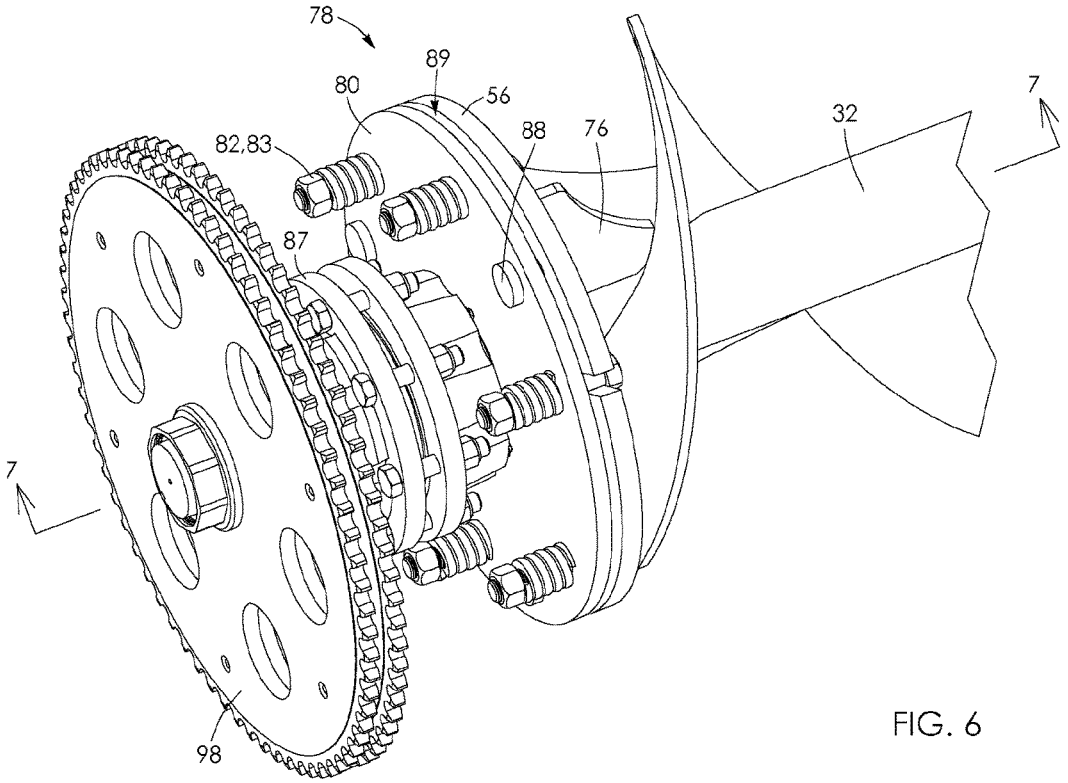
FIG. 6 is an enlarged perspective view, fragmented, of the head assembly of the screw conveyor system in accordance with an embodiment.

Now referring to FIGS. 6 to 8, according to another aspect, the screw conveyor system 20 includes a biasing mechanism 78 configured to allow a deflection of the screw 32 along a longitudinal axis A thereof from a resting position and biasing the screw 32 toward the resting position after the deflection. It is to be understood that a biasing mechanism 78 can allow the screw 32 to deflect in one or many directions and revert it back to its resting position after the deflection had occurred. The biasing mechanism 78 hereby described can be embodied in many ways and that the following embodiment is described for illustrative purposes and can be varied in accordance with the application and size of the apparatus.

In some implementations, the biasing mechanism 78 may include a driving plate 80, the screw head plate 56, biasly mounted in a parallel relationship with previously mentioned driving plate 80; and at least one spring-based component 82 linking the driving plate 80 and the screw head plate 56. In order to describe the biasing mechanism 78 in context, a drive mechanism 86 is introduced. The drive mechanism 86 is configured to drive the screw 32 in rotation. In the embodiment shown, the drive mechanism 86 includes a driving shaft 84 operatively connected to the screw 32 through the biasing mechanism 78. The driving shaft 84 includes, amongst others, a screw seat 90 engaged with the screw shaft 48. The drive mechanism 86 also includes a bearing assembly 87 supporting the driving shaft 84 and allowing rotation thereof. More particularly, the bearing assembly 87 acts as a support to the driving shaft 84 allowing free rotation thereof. For instance, the bearing assembly 87 can be a needle roller bearing suitable for the weight of the driving shaft 84 and the screw 32 and able to withstand the efforts occurring on the screw 32 during operation of the compaction apparatus 22. In the embodiment shown, the screw seat 90 of the driving shaft 84 is shoulder-shaped where the screw head plate 56 is to rest. The screw head plate 56 is therefore resting perpendicularly to the driving shaft 84. The screw seat 90 is shaped and dimensioned so that the driving plate 80 and the screw head plate 56 are mounted in parallel relationship, leaving a gap 89 between the two plates. The gap 89 can for example range between ⅛ of an inch and 1 inch (3.2 to 25.4 millimeters).

Referring to FIGS. 6 to 8, the driving shaft 84 receives torque efforts from an actuator of the drive mechanism 86, which will be described in more details below. The driving plate 80 is secured to the driving shaft 84 and transmits the torque efforts from the driving shaft 84 to the screw head plate 56 via a plurality of pins 88, linking the driving plate 80 to the screw head plate 56. The pins 88 transmit the rotational efforts from the driving plate 80 to the screw head plate 56.

Now returning to the biasing mechanism 78, still referring to FIGS. 6 to 8, the driving plate 80 and the screw head plate 56 are further linked by at least one spring-biased component 82. The spring-biased components 82 can include a spring biased bolt 83. In accordance with an embodiment, the screw head plate 56 is linked to the driving plate 80 by a plurality of such spring biased bolts 83, affixing the screw head plate 56 on the screw seat 90 but allowing the screw head plate 56 to pivot on the screw seat 90. This freedom to pivot on the screw seat 90, in turn, allows a deflection of the screw 32. Accordingly, the deflection of the screw 32 is limited by the gap 89 between the driving plate 80 and the screw head plate 56 and by the dimensions of the inwardly projecting fins 27 located in the main passageway 40. The larger the gap 89, the larger the deflection can get before the driving plate 80 and the screw head plate 56 contact each other. This biasing mechanism 78 can allow the screw 32 to deflect in any direction around the screw 32 longitudinal axis A and can bring back the screw 32 into its resting position after deflection.

In one example, the biasing mechanism 78 can allow the screw 32 to deflect between 0 and 5°. In the embodiment shown in FIGS. 6 to 8, the biasing mechanism 78 allows the screw 32 to deflect of about 5/16 of an inch (about 7.9 millimeters) at the end extremity of the distal segment 52 when the screw 32 is deflected toward the clock position 3, 6 and 9 o'clock according to the longitudinal axis A of the screw 32. This deflection corresponds to a deflection angle of about 0.35°. When the screw 32 is deflected toward 12 o'clock according to the longitudinal axis A of the screw 32, in direction of the by-pass passageway 42, the end extremity of the distal segment 52 can deflect of about % of an inch (about 19.1 millimeters). This deflection corresponds to a deflection angle of about 0.81°.

The biasing mechanism 78 is advantageous in that it can allow the screw 32 to deflect under heavy load of materials or when an incompressible and/or large object is to pass in the passageway structure 34. A deflection can allow more clearance between the screw outer edge 44 and the passageway walls 36, hence avoiding jams of the screw conveyor system 20 during operation. The permitted angle of deflection can take into account the clearance between the screw outer edge 44 and the desired shredding effect described above when the screw conveyor system 20 is in operation. If the permitted angle of deflection is greater, the shredding effect can be less effective because the screw can deflect more and allow passage of larger pieces of materials into the passageway structure 34.

Now referring to FIGS. 4 and 5, in some implementations, the drive mechanism 86 of the screw conveyor system 20 will be described in more details. In addition to the driving shaft 84, the drive mechanism 86 includes an actuator to engage the driving shaft 84 in rotation. In the embodiment shown, the actuator of the drive mechanism is a hydraulic motor 92. The hydraulic motor 92 can be a variable delivery motor. A variable delivery motor can adapt the power and the torque developed according to the resistance submitted to the motor. In one variant, the hydraulic motor 92 can be positioned in a parallel fashion with the screw 32 of the screw conveyor system 20 in order to make a more compact assembly. In order to operatively connect the hydraulic motor 92 to the driving shaft 84, or directly to the screw 32, in some implementations, the drive mechanism 86 can include a gear assembly 93. The gear assembly 93 can include, in one variant, a reduction gear 94, a first drive gear 96, a second drive gear 98 and a chain 100, operatively connected together.

Figure 4A:
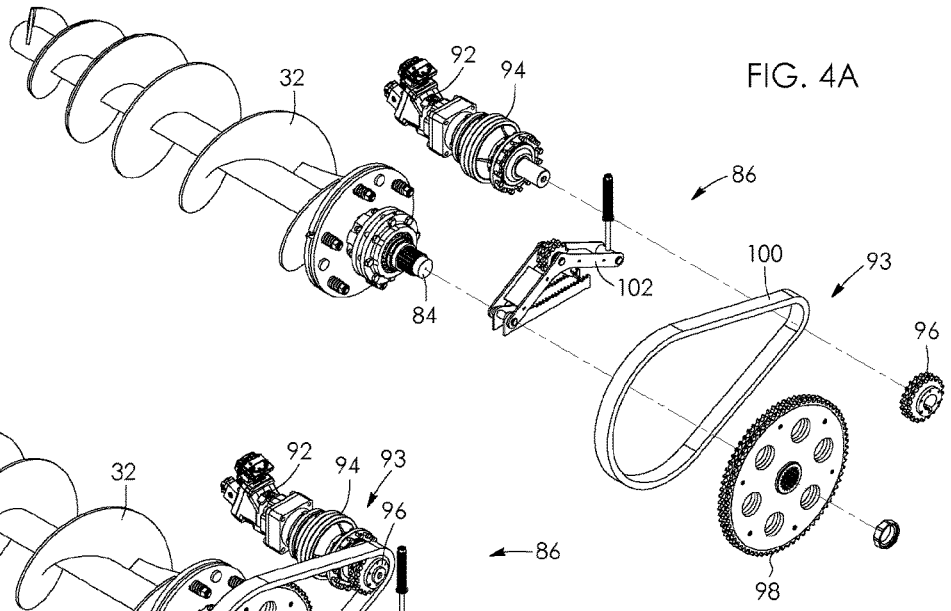
FIG. 4A is an exploded view of the components required to drive the screw conveyor system, shown in FIG. 4B, in accordance with an embodiment.
Figure 4B:
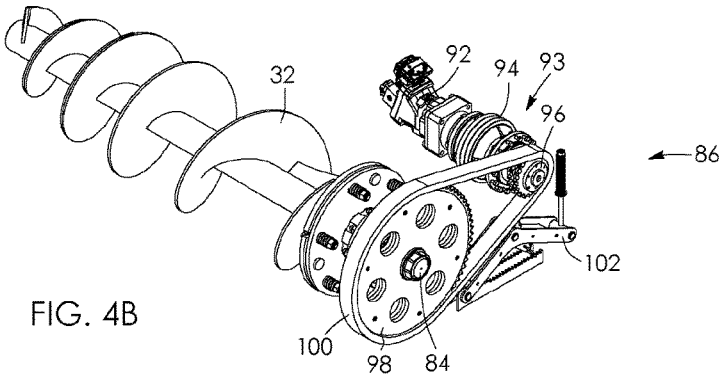
FIG. 4B is a perspective view of the components required to drive the screw conveyor system in accordance with an embodiment.

Still referring to FIGS. 4 and 5, the hydraulic motor 92 is coupled to the reduction gear 94 and engages same in rotation. The reduction gear 94 can have, for example and without being limitative, a reduction ratio of 17.2:1 in order to reduce the output revolutions per minute from the hydraulic motor 92 so that the hydraulic motor 92 can be used at an efficient regime. The reduction gear 94 is in turn engaged with a first drive gear 96. The first drive gear 96 is in turn operatively connected to a second drive gear 98 by the chain 100. It is to be understood that the chain 100 can be replaced, in another variant, by a belt or any suitable connecting device operatively connecting the first and second drive gears 96, 98 and allowing the transmission of rotational efforts between the first and second drive gears 96, 98. The second drive gear 98 is affixed to the driving shaft 84 and therefore transmits the rotational efforts to the screw 32, as described above. Hence, the driving shaft 84 is operatively connected, at one end, to the second drive gear 98 and, at the other end, to the driving plate 80 of the biasing mechanism 78. In view of the above, the gear assembly 93 can use the output revolutions per minute from the hydraulic motor 92 so that the screw 32 rotates at a desired speed. For instance and without being limitative, the ratio between the second and first drive gears 96, 98 can be of 3.6:1 in order to make the screw 32 to rotate at a desired speed. Optionally, the drive mechanism 86 can further includes a chain tensioner 102 operatively connected to the chain 100 to tension the same.

The above-mentioned components of the gear assembly 93 can be configured in order to provide a compact assembly to the drive mechanism 86, such as the assembly illustrated on FIGS. 4 and 5, where the hydraulic motor 92 is mounted in a parallel fashion to the screw 32. Alternatively, the hydraulic motor 92 can be mounted perpendicularly to the screw 32. In some implementations, the first and second drive gears 96, 98 can be operatively connected directly if they are right angle gears. This configuration still provides a compact assembly of the drive mechanism 86.

In one variant, the hydraulic motor 92 can develop a maximum torque of about 21 000 pound-foot (28472 newton-meters) at 5 revolutions per minute and the minimum torque figure can be of about 4 200 pound-foot (5694 newton-meters) at 25 revolutions per minute. Accordingly, in some implementations, the screw 32 can rotate at a rate of 25 revolutions per minute, exhibiting maximum rotational speed but minimal torque. Conversely, at maximum effort, the screw 32 can rotate at a rate of 5 revolutions per minute exhibiting minimum rotational speed but maximum torque. The hydraulic motor 92 can be operatively connected and driven by the engine of a vehicle or by an electric motor, whether or not used on a vehicle.

In some implementations, the compaction apparatus 22 can be used as a separate device or can be incorporated in equipment which also performs other tasks. As illustrated on FIG. 14, the compaction apparatus 22 can be adapted on a material transportation vehicle 30. For instance, the compaction apparatus 22 can be mounted to a compaction apparatus receiving frame 31 supported on wheels, thereby forming a mobile compaction apparatus. In the embodiment shown, the material transportation vehicle 30 is an autonomous mobile vehicle and, more particularly, a truck with a cab 33 at a front end thereof.

In this specification, the terms "forward", "front", "rearward", and "rear" are interpreted with respect to a travel direction of the material transportation vehicle 30 in a forward direction.

The hopper 24 and the container 28 are mounted to the compaction apparatus receiving frame 31, rearwardly of the cab 33. The hopper 24 is located between the container 28 and the cab 33, i.e. forwardly of the container 28 and rearwardly of the cab 33. The hopper 24 includes a hopper intake 23 located on a lateral side of the material transportation vehicle 30. Hence, materials can be collected from the lateral side of the material transportation vehicle 30 and introduced into the hopper 24. Thus, the screw conveyor system 20 described above is configured to convey materials toward the rear end of the material transportation vehicle 30. This configuration allows compacted material unloading from the container 28 at the rear end of the material transportation vehicle 30.

The mobile compaction apparatus includes a screw conveyor system 20 with a passageway structure located between the hopper 24 and the container 28 and allowing passage of the materials and a screw 32 for conveying rearwardly the material, between the hopper 24 and the container 28. The passageway structure 34 further includes an aperture extending therethrough. The aperture can be asymmetrical, as described above.

The above-described mobile compaction apparatus encompasses both autonomous and towed mobile vehicles. Hence, for example, the compaction apparatus receiving frame 31 can include a towing engine coupling at a front end thereof engageable to a towing engine. The towing engine can be used to tow the mobile compaction apparatus and, optionally, the mobile compaction apparatus can be operatively connected and driven by the towing engine.

Of course, numerous modifications could be made to the embodiments described above without departing from the scope of the invention as defined in the appended claims.

The invention claimed is:

1. A screw conveyor system for a compaction apparatus having a hopper receiving materials and a container storing the materials in a compacted fashion, the screw conveyor system comprising:

a screw conveying the materials from the hopper to the container and including a proximal segment including flights extending in the hopper and a distal segment including flights extending in the container, the screw having a longitudinal axis; and a passageway structure comprising a tunnel-like passage defined by at least one passageway wall, the tunnel-like passage allowing passage of the materials between the hopper and the container and being traversed by the screw, the passageway structure separating the hopper from the container, the tunnel-like passage being accessible from the hopper through an aperture having an asymmetrical shape along a cross-sectional axis extending normal to the longitudinal axis of the screw, the aperture conforming to a shape of the tunnel-like passage adjacent to the hopper, and the passageway structure comprising:

a main passageway wherein the at least one passageway wall conforms to a circumferential perimeter of the screw along a majority of the circumferential perimeter of the screw; and a by-pass passageway extending outwardly beyond the circumferential perimeter of the screw and offset from the main passageway.

2. The screw conveyor system according to claim 1, wherein the proximal segment of the screw is located in a bottom portion of the hopper.

3. The screw conveyor system according to claim 1, wherein a ratio between a length of the distal segment of the screw and a length of the container is comprised between 0.20 and 0.50.

4. The screw conveyor system according to claim 1, wherein a portion of the proximal segment of the screw traverses the passageway structure.

5. The screw conveyor system according to claim 1, wherein the by-pass passageway is located solely in a top right portion of the passageway structure for a rotation of the screw in a clockwise direction.

6. The screw conveyor system according to claim 1, wherein the by-pass passageway and the main passageway have respective aperture areas defining a ratio between 0.20 and 0.40 and the by-pass passageway is located in a top right portion of the passageway structure.

7. The screw conveyor system according to claim 1, wherein the passageway structure comprises a plurality of inwardly projecting fins projecting from the passageway wall into the tunnel-like passage, the plurality of inwardly projecting fins extending along the longitudinal axis of the screw.

8. The screw conveyor system according to claim 1, wherein a circumferential perimeter of the passageway structure is invariable and a circumferential perimeter of the main passageway is substantially circular.

9. The screw conveyor system according to claim 1, wherein a circumferential perimeter of the by-pass passageway comprises a square-shaped corner.

10. The screw conveyor system according to claim 1, wherein the screw comprises:

a screw shaft;

a helical screw blade extending around the screw shaft and having an outer edge; and a screw head plate affixed to an end of the screw shaft and extending perpendicularly thereto.

11. The screw conveyor system according to claim 10, wherein the helical screw blade comprises a first group of flights having a first pitch along the proximal segment and a second group of flights having a second pitch along the distal segment, the second pitch being different from the first pitch of the first group of flights.

12. The screw conveyor system according to claim 11, wherein the first group of flights has a first diameter and the second group of flights has at least one second diameter smaller than the first diameter.

13. The screw conveyor system according to claim 11, wherein the first group of flights has a first edge thickness and the second group of flights has a second edge thickness different from the first edge thickness.

14. The screw conveyor system according to claim 10, wherein the helical screw blade and the screw shaft each have a surface provided with a hard facing pattern.

15. The screw conveyor system according to claim 10, wherein the screw comprises at least one stabilizing rib connected to the screw head plate and to the screw shaft.

16. The screw conveyor system according to claim 10, further comprising a biasing mechanism configured to allow a deflection of the screw from a resting position along a longitudinal axis thereof and biasing the screw toward the resting position after said deflection.

17. The screw conveyor system according to claim 16, wherein the biasing mechanism comprises:

a driving plate;

the screw head plate, biasly mounted in a parallel relationship with said driving plate and spaced-apart thereof; and at least one spring-based component linking the driving plate and the screw head plate.

18. A compaction apparatus comprising:

a hopper receiving materials;

a container storing the materials in a compacted fashion; and a screw conveyor system comprising:

a screw conveying the materials from the hopper to the container and including a proximal segment including flights extending in the hopper and a distal segment including flights extending in the container, the screw having a longitudinal axis; and a passageway structure comprising a tunnel-like passage defined by at least one passageway wall, the tunnel-like passage allowing passage of the materials between the hopper and the container and being traversed by the screw, the passageway structure separating the hopper from the container, the tunnel-like passage being accessible from the hopper through an aperture having an asymmetrical shape along a cross-sectional axis extending normal to the longitudinal axis of the screw, the aperture conforming to a shape of the tunnel-like passage adjacent to the hopper, and the passageway structure comprising:

a main passageway wherein the at least one passageway wall conforms a circumferential perimeter of the screw along a majority of the circumferential perimeter of the screw; and a by-pass passageway extending outwardly beyond the circumferential perimeter of the screw and offset from the main passageway.

19. The compaction apparatus according to claim 18, wherein the hopper comprises a hopper trough, the proximal segment of the screw being received herein, and the container comprises a container trough, the distal segment of the screw being received herein.

20. The compaction apparatus according to claim 18, wherein a shape of the asymmetrical aperture is invariable.

21. A screw conveyor system for a compaction apparatus having a hopper receiving materials and a container storing the materials in a compacted fashion, the screw conveyor system comprising:

a screw conveying the materials from the hopper to the container and including a proximal segment extending in the hopper, the screw having a longitudinal axis; and a passageway structure comprising a tunnel-like passage defined by at least one passageway wall, the passageway structure being traversed by the screw and separating the hopper from the container, the passageway structure defining an aperture allowing passage of the materials between the hopper and the container, the aperture having an asymmetrical shape along a cross-sectional axis extending normal to the longitudinal axis of the screw and the passageway structure comprising:

a main passageway shaped to be in close relation to a circumferential perimeter of the screw along a majority thereof; and a by-pass passageway extending outwardly beyond the circumferential perimeter of the screw and offset from the main passageway, the by-pass passageway being located solely in a top right portion of the passageway structure for a rotation of the screw in a clockwise direction wherein the passageway wall substantially conforms to a circumferential perimeter of the screw in a top left portion of the passageway structure.

22. The screw conveyor system according to claim 21, wherein the screw comprises a distal segment including flights extending in the container, and the at least one passageway wall conforming to a circumferential perimeter of the screw along a majority thereof with a shape of the asymmetrical aperture being invariable.

23. The screw conveyor system according to claim 21, further comprising a biasing mechanism configured to allow a deflection of the screw from a resting position along a longitudinal axis thereof and biasing the screw toward the resting position after said deflection.

24. A compaction apparatus comprising:

a hopper receiving materials;

a container storing the materials in a compacted fashion; and a screw conveyor system comprising:

a screw conveying the materials from the hopper to the container and including a proximal segment extending in the hopper, the screw having a longitudinal axis; and a passageway structure comprising a tunnel-like passage defined by at least one passageway wall, the passageway structure being traversed by the screw and separating the hopper from the container, the passageway structure defining an aperture allowing passage of the materials between the hopper and the container, the aperture having an asymmetrical shape along a cross-sectional axis extending normal to the longitudinal axis of the screw and the passageway structure comprising:

a main passageway shaped to be in close relation to a circumferential perimeter of the screw along a majority thereof; and a by-pass passageway extending outwardly beyond the circumferential perimeter of the screw and offset from the main passageway, the by-pass passageway being located solely in a top right portion of the passageway structure for a rotation of the screw in a clockwise direction wherein the passageway wall substantially conforms to a circumferential perimeter of the screw in a top left portion of the passageway structure.

* * * * *